US009538783B2

(12) United States Patent
Xiang

(10) Patent No.: US 9,538,783 B2
(45) Date of Patent: Jan. 10, 2017

(54) ELECTRONIC CIGARETTE CASE WITH THE ABILITY OF MOBILE DATA STORAGE

(71) Applicant: Zhiyong Xiang, Shenzhen (CN)

(72) Inventor: Zhiyong Xiang, Shenzhen (CN)

(73) Assignee: HUIZHOU KIMREE TECHNOLOGY CO., LTD. SHENZHEN BRANCH, SHENZHEN (CN)

( * ) Notice: Subject to any disclaimer, the term of this patent is extended or adjusted under 35 U.S.C. 154(b) by 675 days.

(21) Appl. No.: 13/897,752

(22) Filed: May 20, 2013

(65) Prior Publication Data

US 2014/0305820 A1 Oct. 16, 2014

(30) Foreign Application Priority Data

Apr. 15, 2013 (CN) ..... 2013 1 0128738

(51) Int. Cl.
*A24F 15/18* (2006.01)
*A24F 47/00* (2006.01)

(52) U.S. Cl.
CPC ..... *A24F 15/18* (2013.01); *A24F 47/008* (2013.01)

(58) Field of Classification Search
CPC ..... A24F 15/12; A24F 15/18; A24F 15/20; A24F 47/002; A24F 47/008
USPC ..... 206/236; 131/273
See application file for complete search history.

(56) References Cited

U.S. PATENT DOCUMENTS

2005/0062459 A1* 3/2005 Young ..... H02J 7/0031 320/134
2011/0265806 A1* 11/2011 Alarcon ..... A24F 47/00 131/273
2012/0187897 A1* 7/2012 Lenk ..... H01M 10/44 320/101
2014/0083443 A1* 3/2014 Liu ..... H02J 7/0044 131/329

* cited by examiner

*Primary Examiner* — Yalkew Fantu
*Assistant Examiner* — Manuel Hernandez
(74) *Attorney, Agent, or Firm* — Tim Tingkang Xia, Esq.; Locke Lord LLP

(57) ABSTRACT

An electronic cigarette case comprising a case body to accommodate electronic cigarettes is provided, the electronic cigarette case further comprises a storage managing module, a storage and a data transmission interface, the storage and the data transmission interface are in communication with the storage managing module, the storage managing module will read external data from external electronic equipments through the data transmission interface and write the external data into the storage for storing; or the storage managing module will read the stored data from the storage and transfer them to the external electronic equipments through the data transmission interface. Thus, the electronic cigarette case and the mobile storage device can be integrated as a whole to make it friendly for users to be carried.

4 Claims, 2 Drawing Sheets

ELECTRONIC CIGARETTE CASE WITH THE ABILITY OF MOBILE DATA STORAGE

CROSS-REFERENCE TO RELATED APPLICATIONS

This non-provisional application claims priority under 35 U.S.C. §119(a) on Patent Application No. 201310128738.1 filed in P.R. China on Apr. 15, 2013, the entire contents of which are hereby incorporated by reference.

FIELD OF THE INVENTION

The present invention relates to the field of electronic cigarette, and more particularly relates to an electronic cigarette case with the ability of mobile data storage.

BACKGROUND OF THE INVENTION

At present, the product of electronic cigarette is widely used since it is not only easy to be carried and able to store electronic cigarettes, but also able to charge the bodies of the electronic cigarettes through the built-in reserve battery when the electronic cigarettes are exhausted of power.

Nowadays, the demand for data storage becomes more and more widely, users should use mobile storages such as U disk or SD card in many cases. In some cases, the storage of important data or the display of documents may be delayed because of not carrying along the mobile storage, thus bringing inconvenience to living, work and study. Besides, it is easy for users to forget this, that and the other when carrying too many electronic products, and difficult to manage their belongings to cause inconvenience. It will bring great convenience if the data storage function can be integrated into the common electronic cigarette case.

SUMMARY OF THE INVENTION

The object of the present invention is to provide an electronic cigarette case with the ability of mobile data storage, aiming at the aforementioned drawbacks in the prior art that the electronic cigarette is without the ability of data storage.

The technical solutions adopted to solve the technical problem are as follows: an electronic cigarette case comprising a case body to accommodate electronic cigarettes is provided, the electronic cigarette case further comprises a storage managing module, a storage and a data transmission interface, the storage and the data transmission interface are in communication with the storage managing module, the storage managing module will read external data from external electronic equipments through the data transmission interface and write the external data into the storage for storing; or the storage managing module will read the stored data from the storage and transfer them to the external electronic equipments through the data transmission interface.

Advantageously, the data transmission interface comprises a USB interface.

Advantageously, the data transmission interface comprises an electronic cigarette data transmission interface connected with the electronic cigarette so as to receive user smoking data for storing.

Advantageously, the electronic cigarette case further comprises a case battery charging module to manage the charging of a built-in battery in the case and a control unit to manage the case battery charging module that is in communication with the control unit.

Advantageously, the electronic cigarette case further comprises a boosting module to charge the electronic cigarette inserted into the case, and the boosting module is in communication with the control unit.

Advantageously, the electronic cigarette case further comprises a circuit protecting module to protect the case from over current, over voltage and low voltage, and the circuit protecting module is in communication with the control unit.

Advantageously, the electronic cigarette case further comprises a human-computer interface module to indicate the operative mode of the case and receive instructions from users, and the human-computer interface module is in communication with the control unit.

Advantageously, the storage managing module is integrated in the control unit and also used to read the parameters of the built-in battery from the case battery charging module to store them to the storage, and the parameters of the built-in battery comprises the charging frequency, the charging time, the charging current, and the capacity of the built-in battery in the case.

Advantageously, the control unit may be a micro control unit, a central process unit, a graphic process unit or an application specific integrated circuit chip.

Advantageously, the storage may be a flash.

When implementing the present invention, the following advantageous effects can be achieved: the electronic cigarette case can be equipped with the ability of mobile data storage through being provided with a data transmission interface, as a result, the electronic cigarettes and important data and documents can be stored only through carrying an electronic cigarette case, and it is convenient for users and able to prevent users from forgetting this, that and the other when too many things needed to be carried along so as to improve the daily life, work and study.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

To make the objects, technical schemes and advantages more clearly, the present invention may be further described in detail with reference to the accompanying drawings and embodiments.

Figure 1:
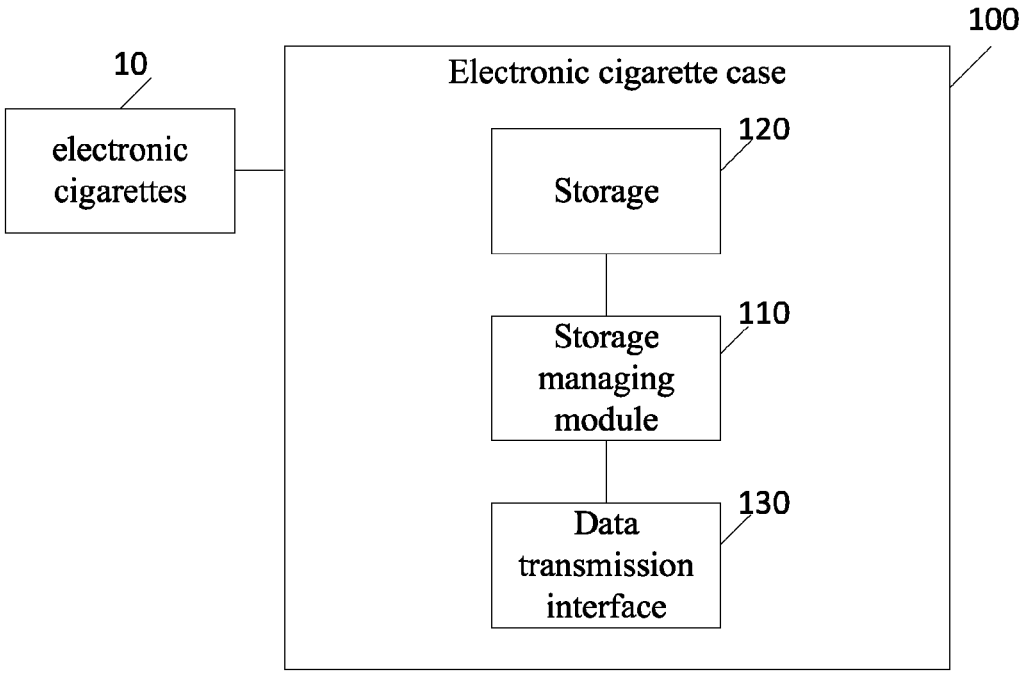
FIG. 1 is a schematic diagram of an electronic cigarette case in accordance with a first embodiment of the present invention.

An electronic cigarette case usually comprises a case body to accommodate electronic cigarettes 10, and there are some functional modules provided in the case body. Referring to FIG. 1, the electronic cigarette case 100 further comprises a storage managing module 110, a storage 120 and a data transmission interface 130. Each of the storage 120 and the data transmission interface 130 is in communication with the storage managing module 110. The storage managing module 110 may be one of any suitable electronic equipments for data processing, such as a micro control unit (MCU), a central process unit (CPU), a graphic process unit (GPU), an application specific integrated circuit (ASIC) chip, etc. The storage 120 may be one of any suitable electronic equipments for data storing, such as a flash storage, a hard disk, a volatile storage, a permanent storage, etc., the capacity of which may be 8GB, 16GB, 32GB etc. The data transmission interface 130 may be one of any suitable electronic equipments connected to external electronic equipments for data transferring, such as a USB interface, a serial port, an infrared interface, a blue tooth interface, etc.

In the working process, the storage managing module 110 will read external data from external electronic equipments through the data transmission interface 130 and write the external data into the storage 120 for storing; or the storage managing module 110 will read the stored data from the storage 120 and transfer them to the external electronic equipments through the data transmission interface 130.

The electronic cigarette case provided in the present invention can be equipped with the ability of mobile data storage through being provided with a data transmission interface, as a result, the electronic cigarettes and important data and documents can be stored only through carrying an electronic cigarette case, and it is convenient for users and able to prevent users from forgetting this, that and the other when too many things needed to be carried along so as to improve the daily life, work and study.

Figure 2:
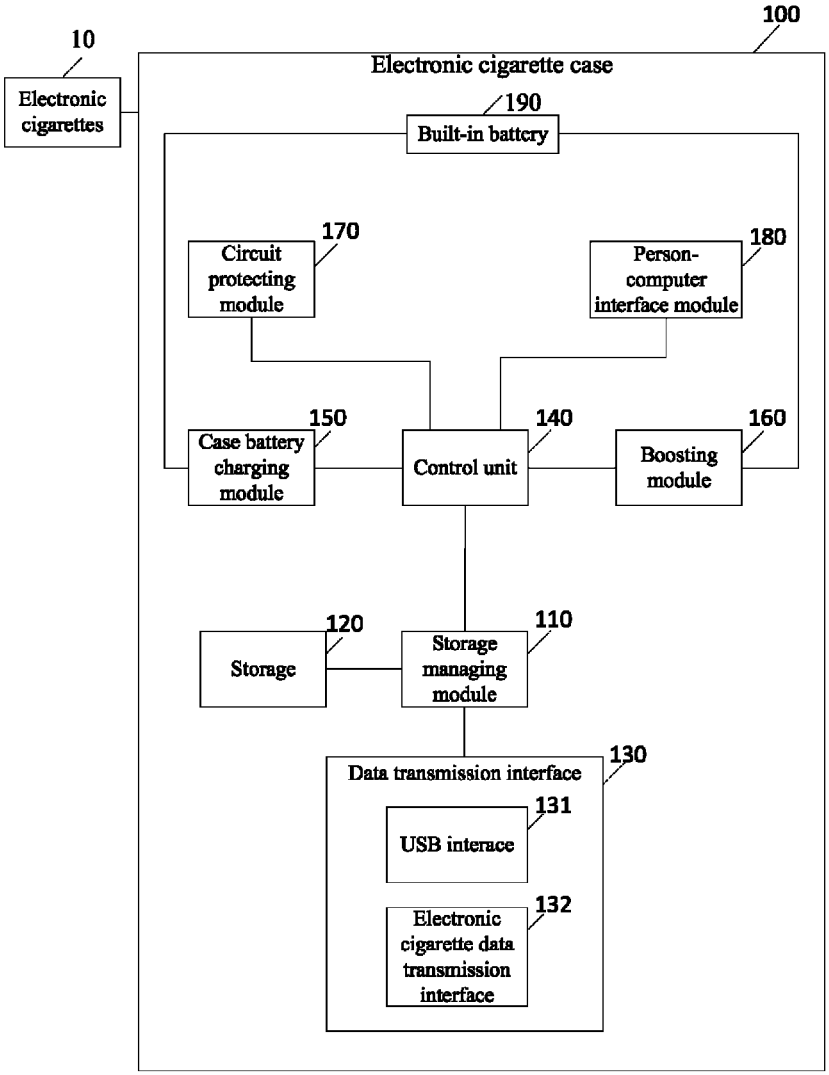
FIG. 2 is a schematic diagram of an electronic cigarette case in accordance with a second embodiment of the present invention.

Preferably, referring to FIG. 2, the data transmission interface 130 can comprise a USB interface 131 and an electronic cigarette data transmission interface 132. Wherein, the electronic cigarette data transmission interface 132 is used to connect with the electronic cigarette so as to exchange user smoking data with the electronic cigarette, and the USB interface 131 is used to connect with other external electronic equipments, such as a desktop computer, a laptop, a tablet computer, a mobile phone, etc., so as to exchange external data with the external equipments. The electronic cigarette transmission interface 132 should match up with the data transmission interface on the electronic cigarette, of course, the electronic cigarette data transmission interface 132 may be one of any suitable electronic equipments used to connect with the electronic cigarette for data transferring, such as a USB interface, a serial port, an infrared interface, a blue tooth interface, etc. The capacity of the built-in storage is always small, which is limited by the size and shape of the electronic cigarette, thus not being able to store the user smoking data for a long time. However, the storing capacity of the storage 120 in the electronic cigarette case is large to store the user smoking data for a long time. As a result, it is convenient for a user to be aware of the process of giving up smoking and beneficial for user to make use of the product of electronic cigarette better.

Referring to FIG. 2, in addition to the storage managing module 110, the storage 120 and the data transmission interface 130, the electronic cigarette case 100 further comprises a control unit 140, a case battery charging module 150, a boosting module 160, a circuit protecting module 170 and a human-computer interface module 180, wherein, each of the case battery charging module 150, the boosting module 160, the circuit protecting module 170 and the human-computer interface module 180 is in communication with the control unit 140 that is used to control the case battery charging module 150, the boosting module 160, the circuit protecting module 170 and the human-computer interface module 180.

The case battery charging module 150 is used to manage the charging of the built-in battery 190 in the case. In an example, the case battery charging module 150 can be connected to an external source through an electric plug in order to charge the built-in battery 190 in the case through the external source. In another example, the case battery charging module 150 can be connected to an external source or a external electronic equipment through the USB interface 131 in order to charge the built-in battery 190 in the case through the external source or the external electronic equipment.

The boosting module 160 is used to charge the electronic cigarette 10 inserted into the case, which is electrically connected to the built-in battery 190 in the case through an interface in order to charge the battery rod of the electronic cigarette 10 inserted into the case through the built-in battery 190 in the case.

The circuit protecting module 170 is used to protect the storage managing module 110, the storage 120, the data transmission interface 130, the control unit 140, the case battery charging module 150, the boosting module 160 and the human-computer interface module 180 from over current, over voltage and low voltage.

The human-computer interface module 180 is used to indicate the operative mode of the cigarette case and receive instructions from users, which may comprise LCDs, LEDs, etc. to display the operative mode of the cigarette case as well as buttons, touching panels to receive instructions from users.

Preferably, the storage managing module 110 is integrated in the control unit 140, namely the storage managing module 110 and the control unit 140 are integrated as a single MCU, CPU, GPU or ASIC. The cost can be reduced through sharing a single control chip.

In addition to reading the data to store them in the storage 120 through the data transmission interface 130, the storage managing module 110 can also be used to read parameters of the built-in battery 190 from the case battery charging module 150 to store into the storage 120, and the parameters of the built-in battery 190 may comprise the charging frequency, the charging period, the charging current and the capacity of the built-in battery 190 in the case.

While the present invention has been described with reference to preferred embodiments, however, the present invention is not limited to above-mentioned embodiments, those modifications, improvements and equivalent substitutions, which don't depart from the scope of the spirit and the principle of the present invention, should be included within the scope of the present invention.

What is claimed is:

1. An electronic cigarette case comprising a case body to accommodate electronic cigarettes, wherein the electronic cigarette case further comprises a storage managing module, a storage and a data transmission interface, the storage and the data transmission interface are in communication with the storage managing module, the storage managing module will read external data from external electronic equipment through the data transmission interface and write the external data into the storage for storage; or the storage managing module will read the stored data from the storage and transfer them to the external electronic equipment through the data transmission interface;

wherein the electronic cigarette case further comprises a case battery charging module, a control unit, a boosting module and a human-computer interface module, the case battery charging module is configured to manage the charging of a built-in battery in the case, the control unit is configured to manage the case battery charging module, the boosting module is configured to charge at least one of the electronic cigarettes inserted into the case, and the boosting module is in communication with the control unit, the human-computer interface module is configured to indicate an operative mode of the case and receive instructions from users, and the case battery charging module, the boosting module and the human-computer interface module are in communication with the control unit:

wherein the data transmission interface comprises a USB interface and an electronic cigarette data transmission interface, the USB interface is used to connect with the external electronic equipment to exchange the external data with the external electronic equipment, the electronic cigarette data transmission interface is connected with the electronic cigarette so as to receive user smoking data for storing;

wherein the case battery charging module is connected to an external source through an electric plug in order to charge the built-in battery in the case through the external source, or the case battery charging module is connected to an external source or the external electronic equipment through the USB interface in order to charge the built-in battery in the case through the external source or the external electronic equipment; and wherein the storage managing module is integrated in the control unit and also used to read parameters of the built-in battery from the case battery charging module to store them to the storage, and the parameters of the built-in battery comprise a charging frequency, a charging time, a charging current, and a capacity of the built-in battery in the case.

2. The electronic cigarette case of claim 1, wherein, the control unit may be a micro control unit, a central process unit, a graphic process unit or an application specific integrated circuit chip.

3. The electronic cigarette case of claim 1, wherein, the storage may be a flash.

4. The electronic cigarette case of claim 1, the boosting module is electrically connected to the built-in battery in the case through an interface in order to charge a battery rod of the electronic cigarette inserted into the case through the built-in battery in the case.

* * * * *